US007251960B1

(12) United States Patent
Zorini et al.

(10) Patent No.: US 7,251,960 B1
(45) Date of Patent: Aug. 7, 2007

(54) CROCHET GALLOON MACHINE

(75) Inventors: Luigi Omodeo Zorini, c/o COMEZ S.P.A.-Via Enrico Fermi 5-P.O.Box 5, 27024 Cilavegna (Pavia) (IT); Marco Carnevale Miino, Mortara (IT)

(73) Assignee: Luigi Omodeo Zorini, Cilavegna (Pavia) (IT)

( * ) Notice: Subject to any disclaimer, the term of this patent is extended or adjusted under 35 U.S.C. 154(b) by 0 days.

(21) Appl. No.: 11/523,158

(22) Filed: Sep. 19, 2006

(30) Foreign Application Priority Data

Jun. 27, 2006 (EP) ..... 06425440

(51) Int. Cl.
*D04B 23/06* (2006.01)

(52) U.S. Cl. ..... 66/204; 66/85 R

(58) Field of Classification Search ..... 66/85 R, 66/84 R, 203, 204, 207, 206, 208
See application file for complete search history.

(56) References Cited

U.S. PATENT DOCUMENTS

| | | | | |
|---|---|---|---|---|
| 4,018,065 A | | 4/1977 | Liebrandt et al. | |
| 4,145,897 A | * | 3/1979 | Villa | 66/207 |
| 4,838,047 A | * | 6/1989 | Zorini | 66/207 |
| 4,984,437 A | | 1/1991 | Zorini | |
| 5,042,273 A | * | 8/1991 | Luigi | 66/208 |
| 5,259,216 A | * | 11/1993 | Zorini | 66/233 |
| 5,327,750 A | * | 7/1994 | Speich | 66/207 |
| 5,544,500 A | * | 8/1996 | Speich | 66/85 R |
| 5,642,631 A | | 7/1997 | Zorini | |
| 6,131,420 A | | 10/2000 | Zorini | |
| 6,209,362 B1 | * | 4/2001 | Speich | 66/207 |
| 6,959,566 B2 | * | 11/2005 | Zorini et al. | 66/204 |

FOREIGN PATENT DOCUMENTS

| | | | |
|---|---|---|---|
| DE | 93 06 474 U1 | 6/1993 | |
| EP | 0393297 | * 10/1990 | 66/85 R |
| EP | 0 787 844 A1 | 8/1997 | |
| EP | 1 013 811 A1 | 6/2000 | |

* cited by examiner

*Primary Examiner*—Danny Worrell
(74) *Attorney, Agent, or Firm*—Pearne & Gordon LLP

(57) ABSTRACT

A crochet galloon machine for warp knitting comprises a front grooved bar (4), a plurality of needles (5) disposed consecutively in side by side relationship along the front grooved bar (4) and movable with a reciprocating motion along a first direction (A), a plurality of eye-pointed needles (8) disposed in front of the needles (5), a plurality of threading tubes (10) disposed above the needles (5). An assembly of interacting levers imparts movement both to the needles 5 and the front grooved bar 4 and is adapted to give the latter an alternated motion component along a second direction (B) substantially parallel to the first motion direction (A), so as to accompany movement of the needles (5) in their longitudinal reciprocating motion and avoid very long needles (5), subject to bending vibrations, to be adopted.

20 Claims, 11 Drawing Sheets

CROCHET GALLOON MACHINE

The present invention relates to a crochet galloon machine. In particular, the present invention is concerned with crochet galloon machines for warp knitting having a fabric pulling direction that is not substantially coincident with the reciprocating motion of the knitting needle. Therefore, imparting a transverse movement to the knitting needles in crochet galloon machines brings to an upward and downward movement of the just formed fabric edge and causes tension fluctuations in the fabric stitches.

BACKGROUND OF THE INVENTION

It is known that in crochet galloon machines for warp knitting, such as crochet galloon looms of the type described in EP0393297, formation of the article of manufacture takes place at a front grooved bar having a horizontal extension and being rigidly supported, at the respective opposite ends, between two side posts being part of the machine base. Operating on the front grooved bar is a plurality of needles disposed consecutively in side by side relationship and simultaneously operated in a reciprocating motion in the direction of their longitudinal extension. A plurality of eye-pointed needles disposed consecutively in side by side relationship operate in front of the needles; they are parallel to the front grooved bar and supported by a guide bar engaged by means of the posts with possibility of sliding and carrying out angular oscillation on the longitudinal extension axis thereof. The guide bar is submitted to the combined action of transverse actuating means giving the eye-pointed needles a reciprocating motion in a direction parallel to the front grooved bar, as well as of angular oscillation means by effect of which the ends of the eye-pointed needles carry out a reciprocating motion in a substantially vertical direction, by alternately moving to a higher level and a lower level relative to the needles themselves.

Movements of the needles and the eye-pointed needles are synchronised in such a manner that when the needles are in a forward or advanced position towards the eye-pointed needles, the latter are in a raised position and carry out a translation motion, each moving from one side to the other of at least one respective needle. During this step the warp yarn of each eye-pointed needle is disposed on either side of the needle, so that it engages in the hooked portion provided on the end of the needle itself.

When the needles move backwards from the forward position, the warp yarn engaged in the hooked portion of each needle forms a loop that is guided through the loop of the knitting stitch formed in the preceding operating cycle, while the stitch itself, retained by the front grooved bar, is discharged from the needle end when said needle is about to reach the end of stroke of the back-moving step. Meanwhile, the eye-pointed needles are brought to a slightly lower level than the needles. When the needles are about to be brought back to the forward position, the eye-pointed needles are horizontally translated in a direction opposite to the horizontal movement previously carried out, so that the warp yarns form new knitting stitches sliding along the needles during the moving forward step. When the needles come close to the forward position again, the eye-pointed needles go back to a slightly higher level than said needles to give rise to a new knitting cycle.

Co-operation between needles and eye-pointed needles gives rise to a sequence of knitting stitches, forming a plurality of parallel chains moving little by little downwards from the front grooved bar.

The chains are further interlaced with the weft yarns carried by respective threading tubes operating above the needles, and disposed consecutively in side by side relationship, parallel to the front grooved bar. The threading tubes are supported by one or more carrier slide bars the opposite ends of which are slidably guided through lifting plates in turn slidably engaged in a vertical direction on the base posts.

Each carrier slide bar is submitted to the action of respective horizontal actuating means giving each threading tube a reciprocating motion parallel to the extension of the front grooved bar. The carrier slide bars are further simultaneously operated with a reciprocating oscillation in a vertical direction, upon command of a kinematic mechanism acting on the lifting plates.

Operation of the carrier slide bars is co-ordinated with that of the needles and the eye-pointed needles, so that each weft yarn is selectively laid on either side of one or more needles to pass below said needles when they reach the return end of stroke and start the advancing motion towards the eye-pointed needles again.

The weft yarn placed under the needles will be interknitted with the knitting stitches formed by the warp yarns in the subsequent operating cycle.

After the above statements, it is to be pointed out that within the field concerning development and improvement of the textile machines, in order to face the increasing market requirements, many efforts are spent in an attempt to increase productivity of the machines themselves and complexity of the articles of manufacture produced by them.

It is also to be pointed out that one of the greatest limitations is presently represented by the maximum number of carrier slide bars disposed in a fan-shaped conformation between the lifting plates to cause the ends of the respective threading tubes to converge as much as possible towards a common alignment direction.

Based on the above considerations it has been found that presently the greatest constraints to productivity of the crochet galloon machines is due to the fact that, to equip the machines with a great number of carrier slide bars, greater than sixteen, it is necessary to use very long needles projecting in overhanging from the needle bar, in order to enable them to reach all threading tubes without the needle bar interfering with the front grooved bar.

In fact, due to said important length, during reciprocation at high speed along their longitudinal extension, the needles would inevitably tend to bend.

These bending deformations bring to an inexact positioning of the individual needles relative to the threading tubes and the eye-pointed needles, and sometimes even to mechanical interferences with consequent risks of damaging and/or breaking these components.

BRIEF SUMMARY OF THE INVENTION

Accordingly, the present invention aims at eliminating the above mentioned drawbacks by proposing a crochet galloon machine for warp knitting enabling productivity to be increased without problems connected with needle vibrations being encountered.

In particular, it is an aim of the present invention to propose a crochet galloon machine enabling knitting to be carried out at high speed and with a high number of carrier slide bars, so that also very complicated decorations can be executed quickly.

Another aim of the present invention consists in devising a very precise crochet galloon machine ensuring, during working, exact mutual positioning of the needles, the eye-pointed needles and the threading tubes, so as to obtain unfaulty articles of manufacture.

It is a further aim of the present invention to conceive a reliable crochet galloon machine, i.e. a machine enabling the disastrous mechanical interferences due to elastic deformations of the machine components to be avoided in a completely sure manner.

The foregoing and further aims are substantially achieved by a crochet galloon machine for warp knitting comprising the features set out in one or more of the appended claims.

BRIEF DESCRIPTION OF THE DRAWINGS

Description of a preferred embodiment of a crochet galloon machine for warp knitting is now given by way of non-limiting example, with reference to the accompanying drawings, in which.

DETAILED DESCRIPTION OF THE PREFERRED EMBODIMENTS OF THE INVENTION

Figure 1:
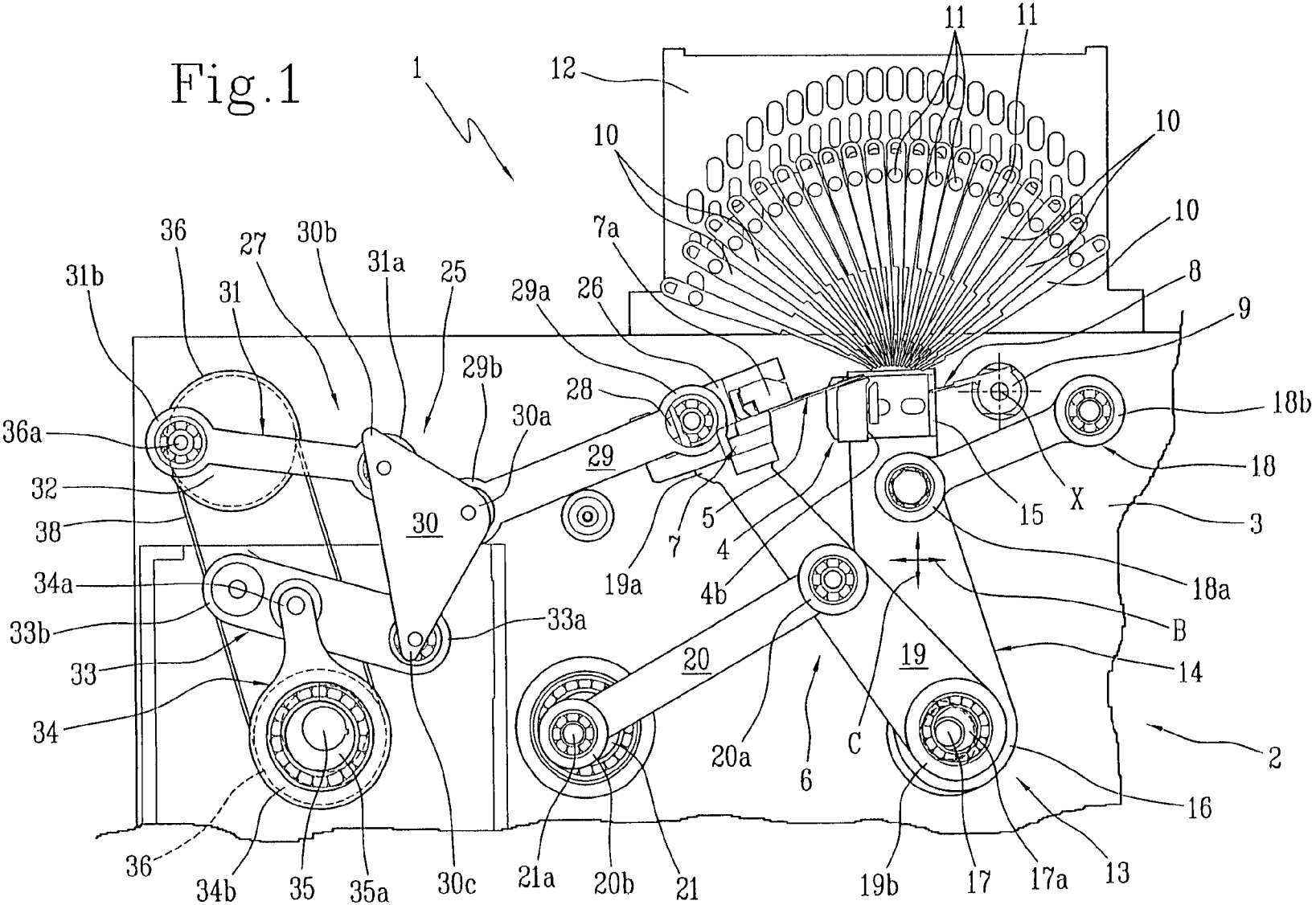
FIGS. 1-4 show a diagrammatic side view of a crochet galloon machine in accordance with the present invention in as many consecutive operating positions.
Figure 2:
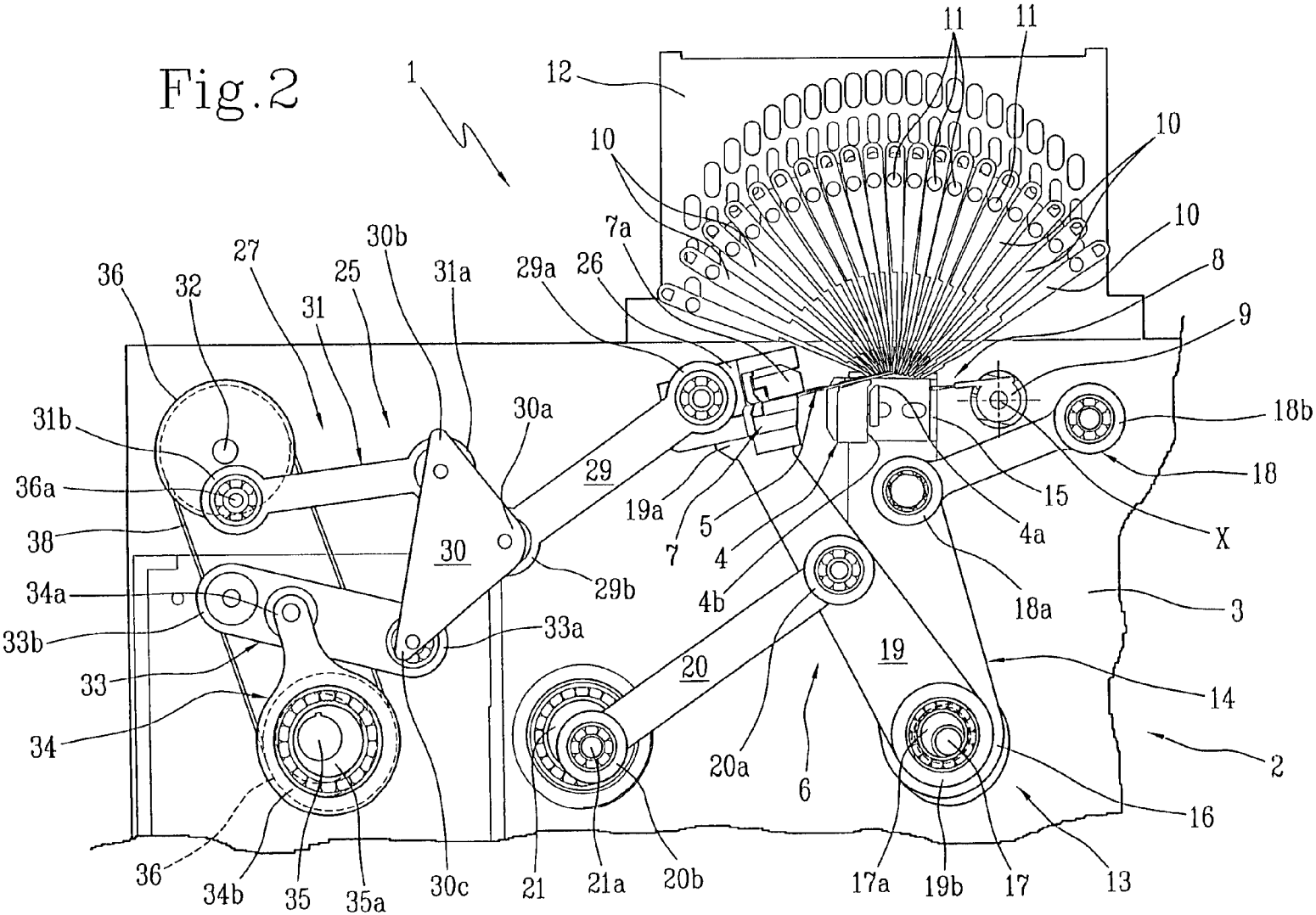
Figure 3:
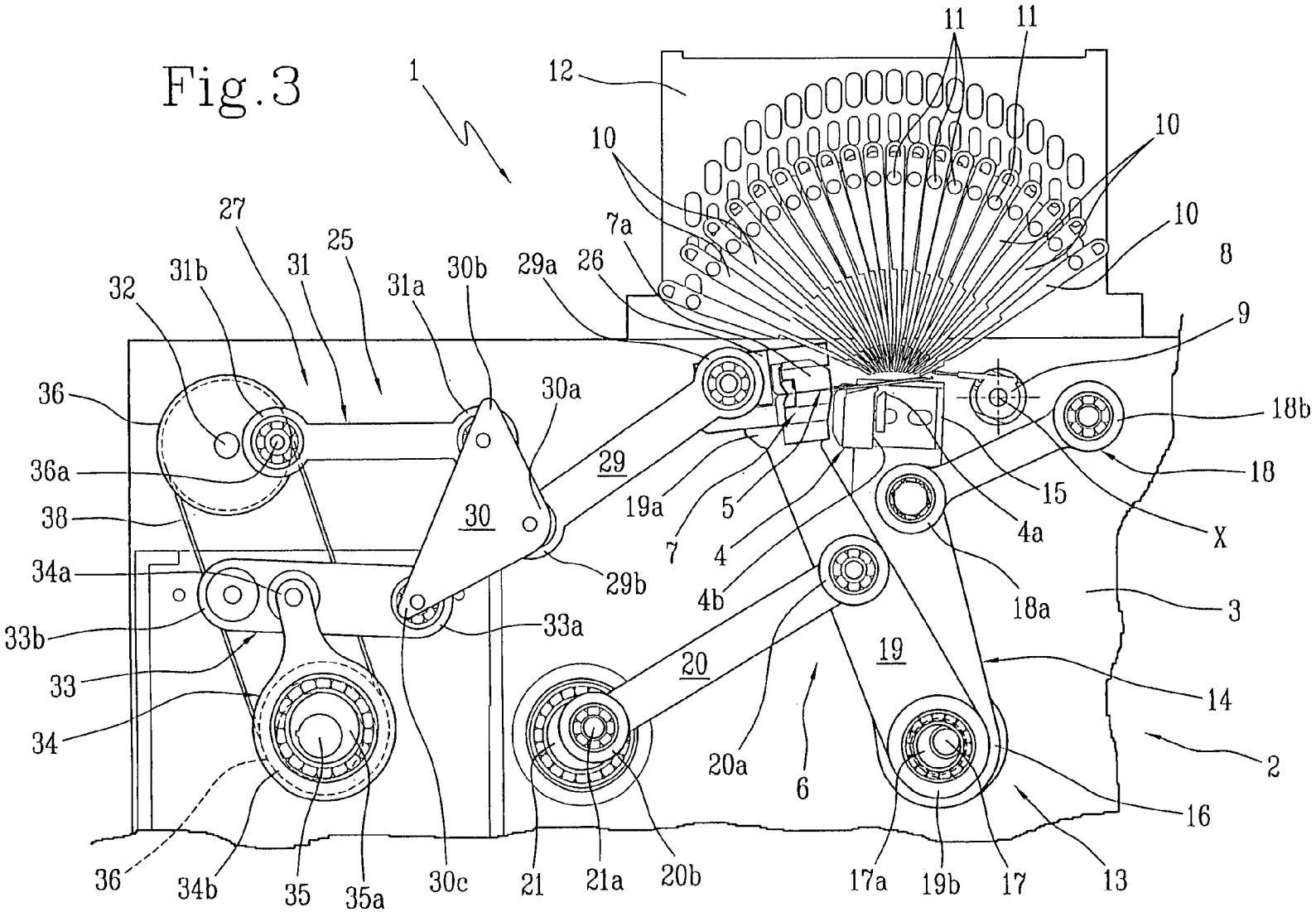
Figure 4:
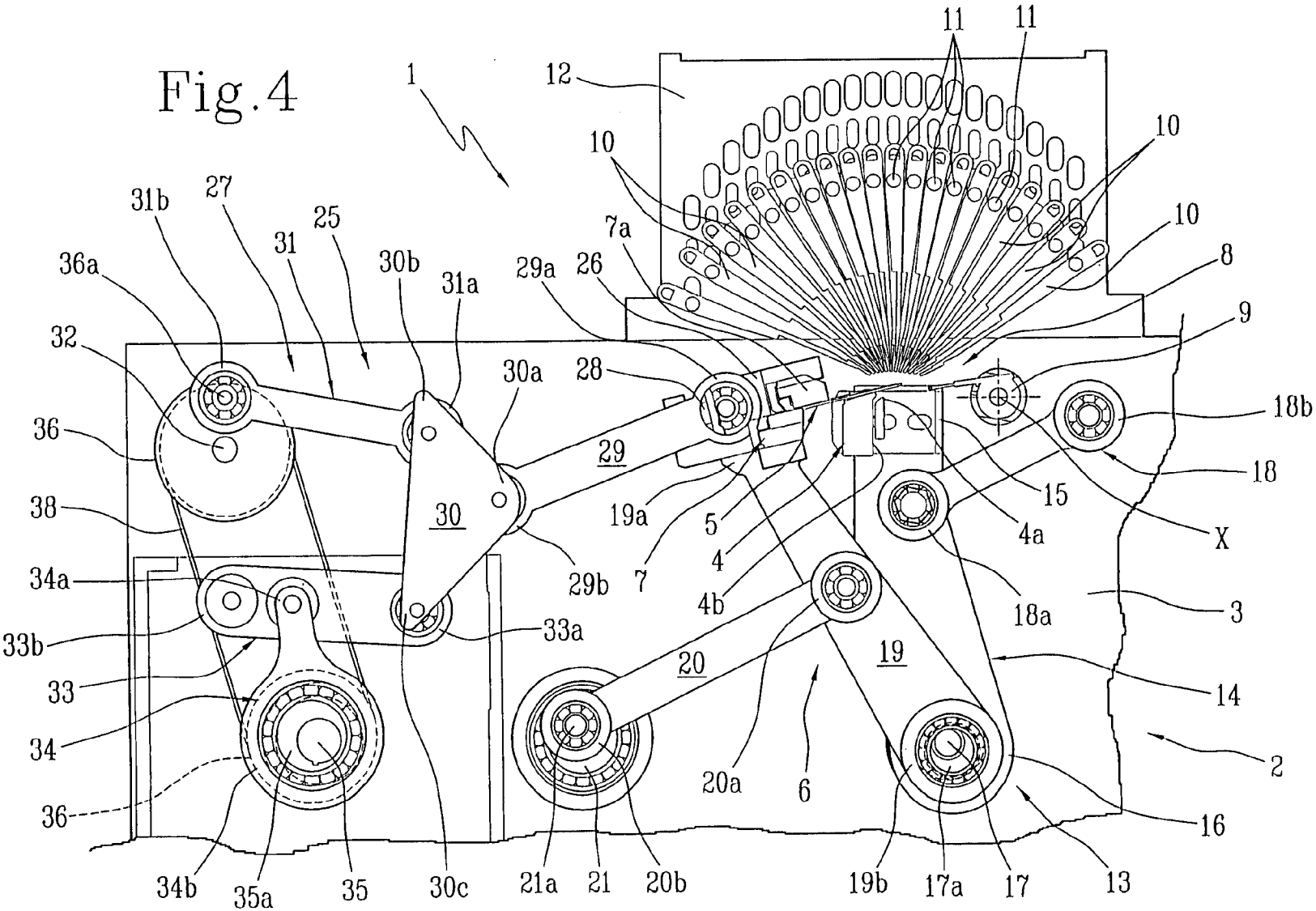

With reference to the drawings, a crochet galloon machine for warp knitting in accordance with the present invention has been generally identified with reference numeral 1.

The crochet galloon machine 1 comprises a supporting base 2 provided with two side posts 3, only one of which is shown in the accompanying figures. Horizontally extending between the posts 3 is at least one front grooved bar 4, at an upper edge 4*a* of which, as better clarified in the following, sequential interlacing of the knitting yarns occurs, so as to form an article of manufacture that then moves downwards in a hollow space 4*b* formed in the front grooved bar 4 itself.

Slidably guided on the front grooved bar 4 is a plurality of knitting needles 5 disposed consecutively in side by side relationship and driven by longitudinal actuating means 6 for movement of the needles 5 and adapted to transmit a reciprocating motion to the needles 5 themselves along the longitudinal extension of same, in a first direction "A" that is preferably horizontal and in any case perpendicular to the longitudinal extension of the front grooved bar 4, as shown by the respective arrow in the accompanying drawings.

Needles 5 are further movable relative to the front grooved bar 4 along said first direction "A" and they each slide in a respective guide groove 4*c* formed in the front grooved bar 4 itself.

In particular, needles 5 are installed on a needle bar 7 rigidly engaging the proximal ends 5*a* of said needles 5.

As shown, needles 5 are inclined to the horizontal and the proximal ends 5*a* of said needles 5 lie in a lower position than the distal ends 5*b*.

Also arranged between the side posts 3 is a plurality of eye-pointed needles 8 disposed consecutively in side by side relationship in a direction parallel to the front grooved bar 4 so as to be placed in front of the hook-shaped distal ends 5*b* of needles 5.

Each of the eye-pointed needles 8 carries, through an eye 8*a*, a respective warp yarn, not shown, coming from a creel or a feeding beam via conventional guide means, in order to suitably engage said warp yarn in the hook-shaped distal end of at least one respective needle 5 for formation of knitting stitches.

In known manner, the eye-pointed needles 8 are fastened to a guide bar 9 parallel to the front grooved bar 4 and slidably guided through posts 3 at the respective opposite ends. The guide bar 9 is submitted to the action of actuating means (not shown) for transverse movement of the eye-pointed needles 8, adapted to give the eye-pointed needles 8 a reciprocating motion substantially parallel to the longitudinal extension of the front grooved bar 4, i.e. perpendicular to the plane identified by the figures shown.

The guide bar 9 is further preferably rotatably movable about its longitudinal extension axis "X", so that it gives the eye 8*a* of each eye-pointed needle 8 a substantially vertical reciprocating motion.

The warp yarns brought to the needles 5 through the eye-pointed needles 8, lend themselves to be interlaced, for manufacture of the article, with weft yarns in turn in engagement above the needles 5, through respective threading tubes 10 disposed consecutively in side by side relationship and parallel to the front grooved bar 5.

In a manner known by itself, the threading tubes 10 are engaged on respective carrier slide bars 11, the number of which can vary depending on the type of working to be carried out. When a plurality of carrier slide bars 11 is provided, the latter and the respective threading tubes 10 are disposed in a fan-shaped configuration in cross section, so that the lower ends 10*a* of the respective tubes 10 converge as much as possible close to the needles 5, as clearly shown in the accompanying drawings.

In the preferred embodiments, the number of tubes 10 of a given cross section is greater than sixteen and preferably equal to twenty.

Actuating means, not shown, for transverse movement of the threading tubes 10 operates on each carrier slide bar 11 to transmit the threading tubes 10 a reciprocating motion parallel to the longitudinal extension of the front grooved bar 4, i.e. perpendicular to the plane identified by the figures shown.

To this aim, each carrier slide bar 11 is slidably guided, in a direction parallel to the front grooved bar 4, through guide plates, only one of which is shown in the figures and generally identified with 12, each fastened to one of the posts 3 of base 2. The threading tubes 10, with respect to needles 5, perform a relative movement extending on either side of the needles 5 themselves.

With reference to a cross section, as shown in each of the accompanying drawings, although the lower ends 10*a* of the corresponding threading tubes 10 converge as much as possible close to needles 5, these lower ends 10*a* of a single cross section, due to their high number, lie substantially along a longitudinal direction "Y" perpendicular to the extension of the bars 4, 7, 9 and substantially horizontal. In more detail, as viewed from FIGS. 5-8 and 10*a*, these lower ends 10*a* are disposed along an arched line.

Therefore, one of the lower ends 10*a* of the tubes 10 aligned along said longitudinal direction "Y lies close to the eye-pointed needles 8, while the opposite end lies close to the needle bar 7.

In accordance with the present invention, also given to the front grooved bar 4 through actuating means 13 is an alternated motion component along a second direction "B" substantially parallel to the first movement direction "A" of needles 5, so as to accompany the movement of said needles 5 in their longitudinal reciprocating motion.

This movement of the front grooved bar 4 allows the needles 5 to reach the lower ends 10*a* of the threading tubes 10 that are more spaced apart from the needle bar 7, i.e. closer to the tubes 10, without use of very long, and therefore very flexible, needles 5 being required.

Movement of the front grooved bar 4 along the second direction "B" is in the same way as that of needles 5. In fact, during movement of needles 5 from the rearmost position, relative to the eye-pointed needles, to the most forward one, the front grooved bar 4 substantially moves in the same direction and in the same way as needles 5, to leave room enough to said needle bar 7 so as to prevent the same from interfering with the front grooved bar 4.

This movement of the front grooved bar 4 can be used on crochet galloon machines 1 with carrier slide bars 11 provided with both reciprocating motion parallel to the longitudinal extension of the front grooved bar 4 and alternate oscillation in a vertical direction, according to an alternative embodiment not shown. In said alternative embodiment, movement of the threading tubes 10 is coordinated with that of needles 5 and eye-pointed needles 8, so that each weft yarn is selectively laid on either side of one or more needles 5 to pass under said needles 5 when the latter reach the return end of stroke and begin the advancing movement towards the eye-pointed needles 8 again. In this case needles 5 are provided with the longitudinal movement alone.

Preferably, in the two embodiments shown, the crochet galloon machine 1 further comprises actuating means for transverse movement of needles 5, to give the needles 5 a reciprocating movement for overlapping along a third direction "C" that is substantially vertical or in any case substantially perpendicular to the first direction "A" and to the transverse movement of the eye-pointed needles 8. The eye-pointed needles 8, therefore with respect to needles 5, perform a relative movement circumscribing the longitudinal axes of the needles 5 themselves, by effect of the combination between said overlapping movement of needles 5 and transverse movement of the eye-pointed needles 8.

In this case, needles 5 are provided with the longitudinal and vertical movements while the carrier slide bars 11 do not move vertically.

In addition, as shown, the mentioned relative movement of the eye-pointed needles 8 circumscribing the longitudinal axes of needles 5 is preferably also obtained by means of the movement of the eye-pointed needles 8 around the longitudinal extension axis "X" of the guide bar 9.

Since in the preferred embodiments needles 5 move also vertically, the actuating means 13 for movement of the front grooved bar 4 gives said front grooved bar 4 also an alternated motion component along the third vertical direction "C", so that said bar moves close to and away from the threading tubes 10 following the motion of needles 5.

In the embodiments shown, as detailed later on, the actuating means for transverse movement of needles 5, the means for longitudinal movement of said needles 5, and the actuating means 13 for movement of the front grooved bar 4 are defined by an assembly of interacting levers imparting movement both to the needles 5 and the front grooved bar 4.

At all events also falling within the scope of the present invention is also adoption of independent (mechanical, electro-mechanical, electronic) mechanisms to separately control operation of the needles 5 and the front grooved bar 4.

Figure 5:
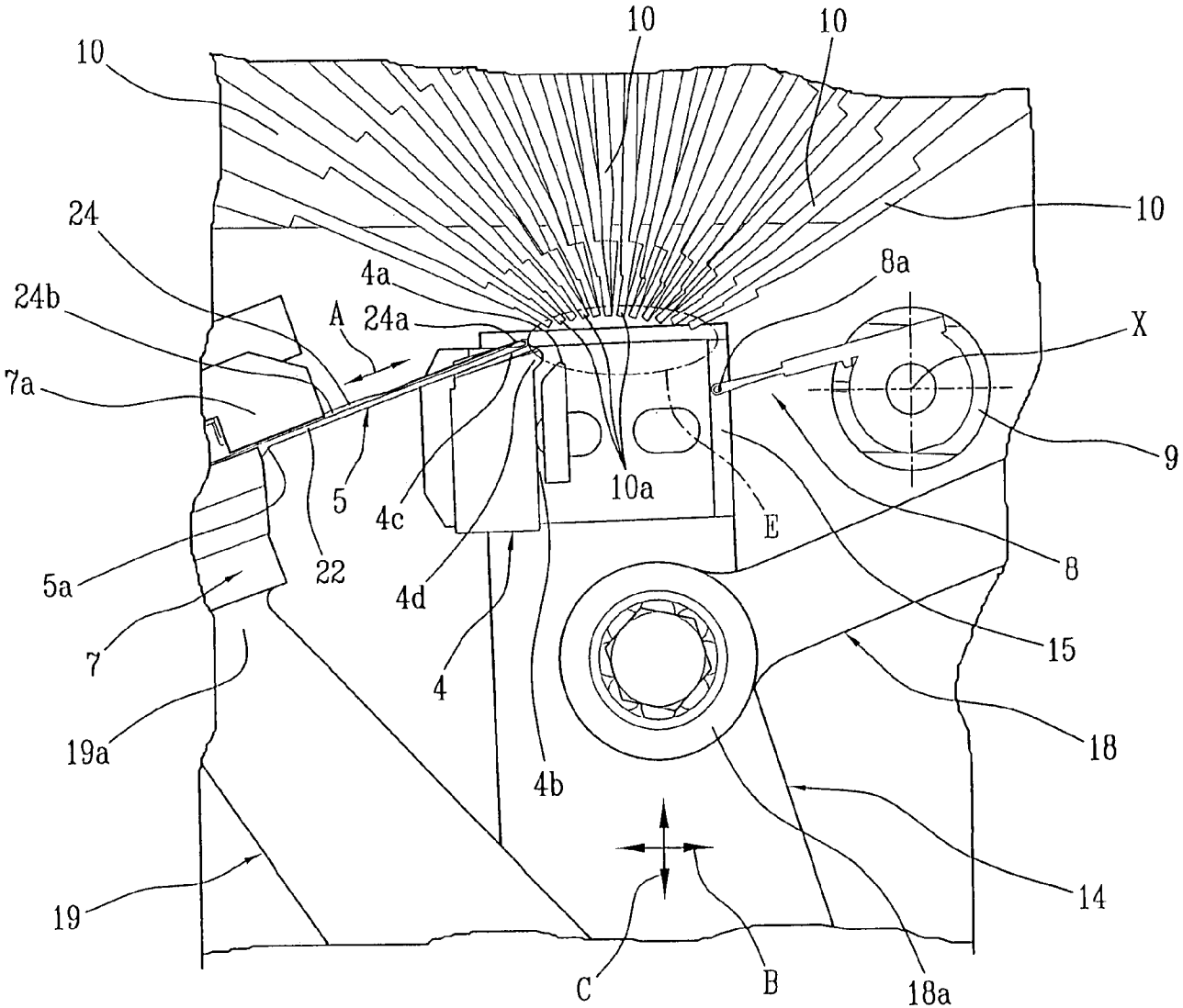
FIGS. 5-8 show an enlarged portion of the machine of the invention in the consecutive operating positions seen in FIGS. 1-4.

Irrespective of the specific solution adopted, the alternated motion component of the front grooved bar 4 along the second direction "B" and the alternated motion component along the third direction "C" define a closed path "E" which is substantially circular and preferably elliptic (FIG. 5).

Figure 6:
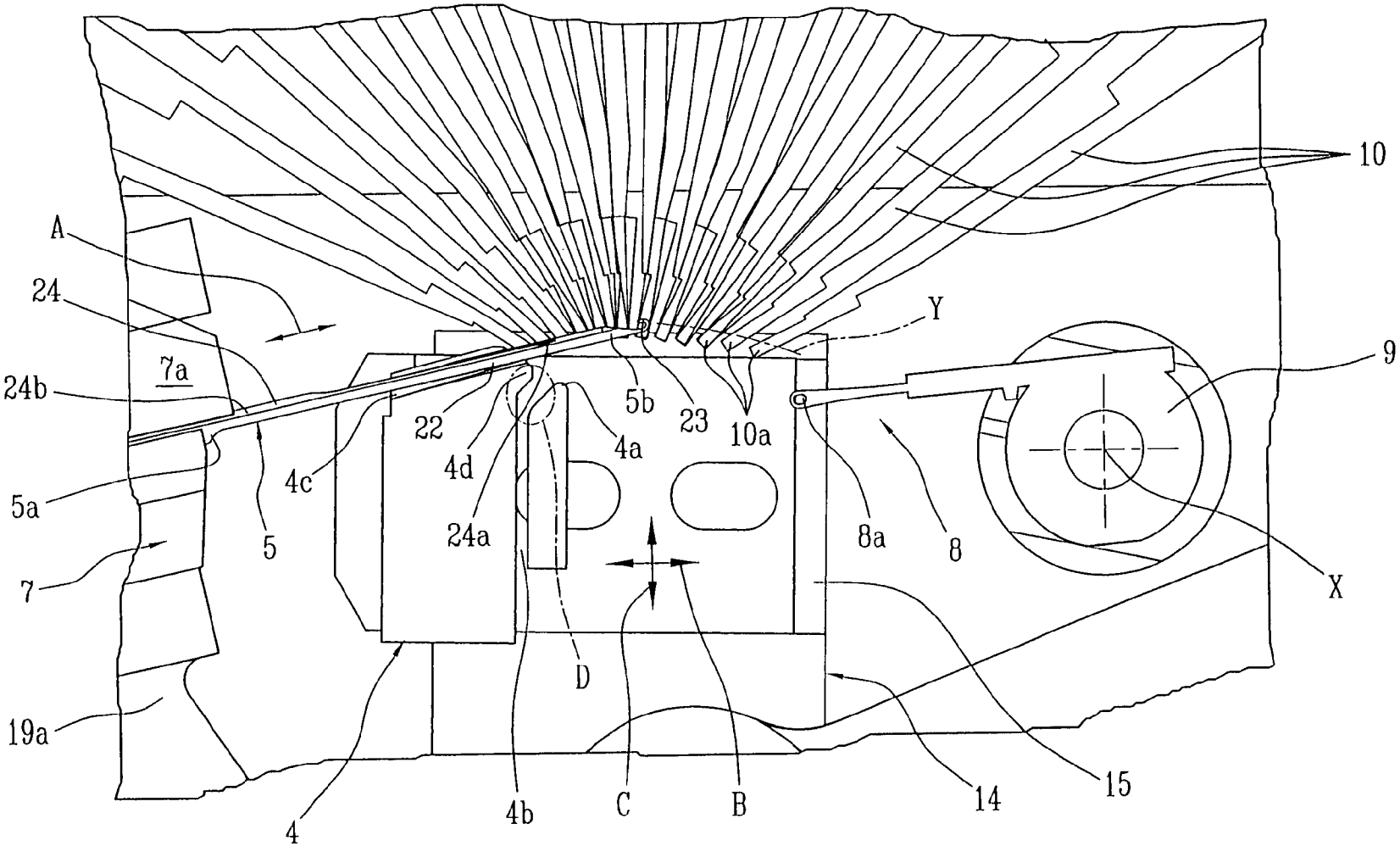

In addition, the alternated motion component of the distal end 5*b* of each of said needles 5 along the first direction "A" and the alternated motion component along the third direction "C" define a closed path "D" which is substantially circular and preferably elliptic (FIG. 6).

The two paths can be designed based on the specific requirements.

In order to give the needles 5 and the front grooved bar 4 the desired movements, the actuating means 13 for movement of the front grooved bar 4 comprises at least one first oscillating drive arm 14 supporting the front grooved bar 4 on a distal end thereof 15.

The first drive arm 14 has a proximal end 16 opposite to the distal end 15 which is eccentrically hinged on a respective power-driven arm 17 rotatably mounted on the base 2 and extending parallel to the front grooved bar 4.

In particular, in the non-limiting embodiments shown, shaft 17 has an eccentric body 17*a* integral with the shaft 17 itself and supporting the proximal end 16 of the first drive arm 14 by means of a bearing. The eccentric body 17*a* has a cylindrical side surface of circular section disposed around the shaft 17, driven in rotation by rotation of shaft 17 and non coaxial with the rotation axis of said shaft 17.

Preferably, the machine 1 is provided with two or more arms 14 connected at several points with the power-driven shaft 17 extending between the two posts 3.

The actuating means 13 for movement of the front grooved bar 4 further comprises at least one connecting rod 18 having a first end 18*a* hinged on the respective first drive arm 14, at a point close to the distal end 15, and a second end 18*b* hinged on the base 2.

The actuating means 6 for movement of the needles 5 comprises at least one second drive arm 19 supporting the needle bar 7 on a distal end 19*a* thereof and oscillating relative to said first drive arm 14, to cause sliding of the needles 5 in the respective grooves 4*c* of the front grooved bar 4.

In particular, a proximal end 19*b* of the second drive arm 19 is hinged on the respective first drive arm 14 at an eccentric position relative to the first power-driven shaft 17.

In the embodiments shown, the second arm 19 is installed by means of a bearing, on the eccentric body 17*a* integral with shaft 17 already supporting the first drive arm 14.

The actuating means 6 for movement of needles 5 further comprises at least one connecting rod 20 having a first end 20*a* hinged on the respective second drive arm 19, at an intermediate point located between the distal end 19*a* and proximal end 19*b*.

A second end 20*b* of the connecting rod 20 is eccentrically hinged on a respective second power-driven shaft 21 rotatably mounted on base 2.

In particular, the second power-driven shaft 21 carries a pin 21*a* mounted in non-coaxial relationship relative to the rotation axis of said second shaft 21 and the second end 20*b* of the connecting rod 20 is installed on pin 21*a*, by means of a bearing for example.

The machine 1 may also be provided with two or more second arms 19 fastened at several points to the second power-driven shaft 21 extending between the two posts 3 of base 2.

Preferably, a first and a second arms 14, 19 are mounted close to each of the two posts 3 of the machine 1. In addition, preferably, the first and second power-driven shafts 17, 21 are connected by a transmission, a belt drive or chain drive for example, and are actuated by a single motor.

According to the first embodiment shown in FIGS. 1-8, each needle 5 is made up of two parts and comprises a first portion 22 having a hook 23 placed at a distal end thereof.

Needle 5 further has a second portion 24 which is movable relative to the first portion 22 between one open position, at which said second portion 24 is translated towards the proximal end 5*a* of needle 5 and its distal end 24*a* is moved apart from hook 23, and a closed position at which said distal end 24*a* of the second portion 24 lies against hook 23 to define a closed loop. Actuating means 25 to move the second portion 24 relative to the first portion 22 shifts needle 5 between the two positions.

In the preferred embodiment shown in FIGS. 1 to 8, the actuating means 25 for the second portions 24 comprises a slider 26 installed on the distal end 19*a* of the second drive arm 19.

Slider 26 carries the second portions 24 of needles 5 and is movable in translation relative to the needle bar 7 by the action of a kinematic mechanism 27.

In more detail, slider 26 slides on a straight guide 28 integral with the distal end 19*a* of the second drive arm 19 and parallel to needles 5.

Slider 26 further carries an auxiliary needle bar 7*a* in which the proximal ends 24*b* of the second portions 24 of needles 5 are inserted.

In more detail in terms of construction, the kinematic mechanism 27 comprises a first rod 29 defined by a plate or two plates disposed side by side for example, and having a first end 29*a* hinged on slider 26.

A connecting body 30 defined by a pair of side-by-side plates each having three vertices 30*a*, 30*b*, 30*c*, is hinged at a first vertex 30*a* thereof, on a second end 29*b* of the first rod 29.

A second rod 31 has a first end 31*a* hinged on the second vertex 30*b* of the connecting body 30 and a second end 31*b* eccentrically hinged on a respective third power-driven shaft 32, which third shaft 32 is rotatably mounted on base 2.

A third rod 33 has a first end 33*a* hinged on the third vertex 30*c* of the connecting body 30 and a second end 33*b* hinged on base 2.

A fourth rod 34 has a first end 34*a* hinged at an intermediate point of the third rod 33 and a second end 34*b* eccentrically hinged on a respective fourth power-driven shaft 35 rotatably mounted on base 2.

As shown in the accompanying drawings, the third power-driven shaft 32 is positioned over the fourth power-driven shaft 35.

In addition, although generally the mechanical coupling between said elements can be made in any manner, pulleys 36 mutually connected by a belt or a chain 38 are installed on the third and fourth power-driven shafts 32, 35.

In addition, pulley 36 mounted on the third shaft 32 carries a pin 36*a* on which the second end 31*b* of the second rod 31 is installed by means of a bearing, for example.

The fourth shaft 35 has an eccentric body 35*a* integral with shaft 35 and supporting the second end 34*b* of the fourth rod 34 by means of a bearing. The eccentric body 35*a* has a cylindrical side surface of circular section disposed around shaft 35, driven in rotation by rotation of the fourth shaft 35 and not in coaxial relationship with the rotation axis of said fourth shaft 35.

In addition, the fourth power-driven shaft 35 is preferably connected to the second power-driven shaft 21 by a transmission, a belt drive or a chain drive for example, not shown because disposed behind post 3.

Figure 9:
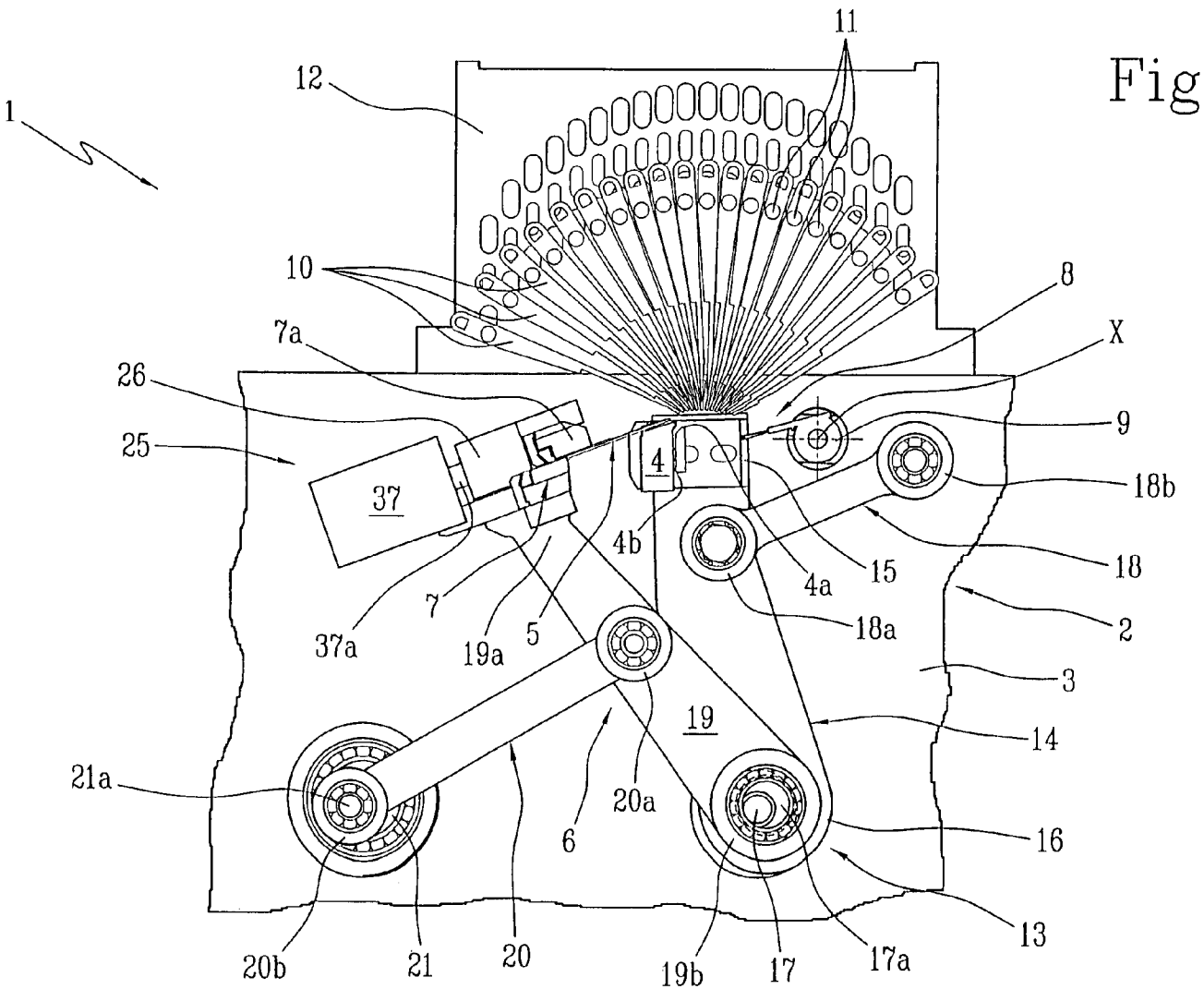
FIG. 9 is a diagrammatic side view of a variant of the crochet galloon machine in accordance with the present invention.

Alternatively, according to an alternative embodiment shown in FIG. 9, the actuating means 25 for the second portion 24 of needles 5 comprises at least one electronically controlled actuator 37 installed on the distal end 19*a* of the second drive arm 19 and operatively connected to the second portion 24.

Actuator 37 only diagrammatically shown, is of the linear type for example, and carries slider 26 with the auxiliary needle bar 7*a* at a distal end of a drive rod 37*a* thereof.

Figure 10:
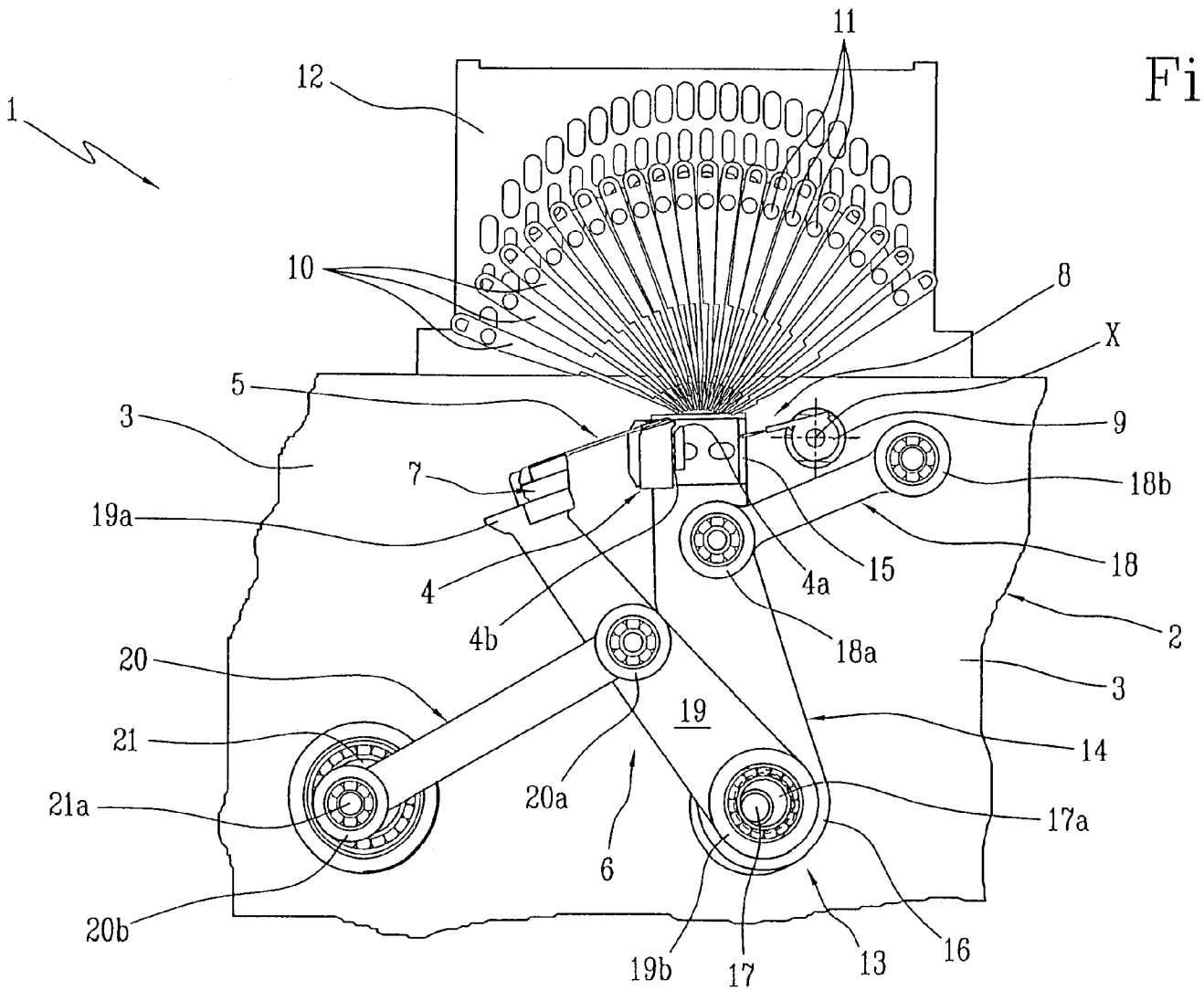
FIG. 10 is a diagrammatic side view of an alternative embodiment of the crochet galloon machine in accordance with the present invention.
Figure 10A:
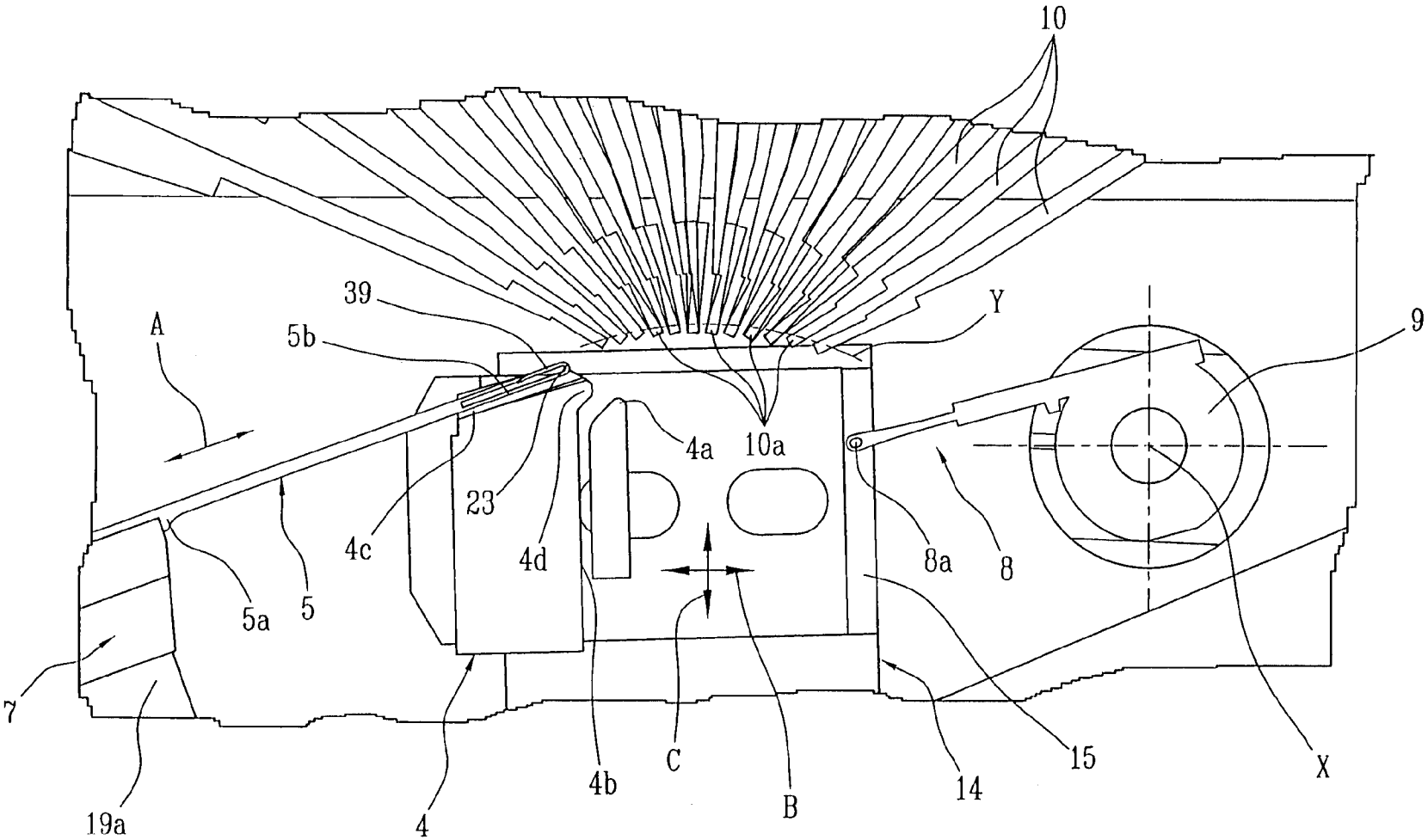
FIG. 10*a* shows a detail of the machine seen in FIG. 10.

In accordance with the second embodiment shown in FIG. 10, needles 5 are of the automatic type, i.e. each needle 5 at a distal end thereof has a hook 23 provided with an resiliently deformable latch 39. The elastic deformation of latch 39 obtained by interference of same with the warp yarns, enables movement of the latch 39 itself between an open position and a loop-shaped closed position of needle 5.

In this second embodiment therefore, as shown in FIG. 10, the kinematic mechanism 27 and actuator 37 for moving the second portion 24 of each needle 5 are not required.

In use, starting from the configuration in FIGS. 1 and 5, needles 5 are in the farthest position relative to the eye-pointed needles 8 and the distal ends 5*b* of needles 5 do not lie under the lower end 10*a* of any threading tube 10. The front grooved bar 4 is disposed under the end 10*a* of tube 10 which is placed to the greatest distance from the eye-pointed needles 8.

Figure 7:
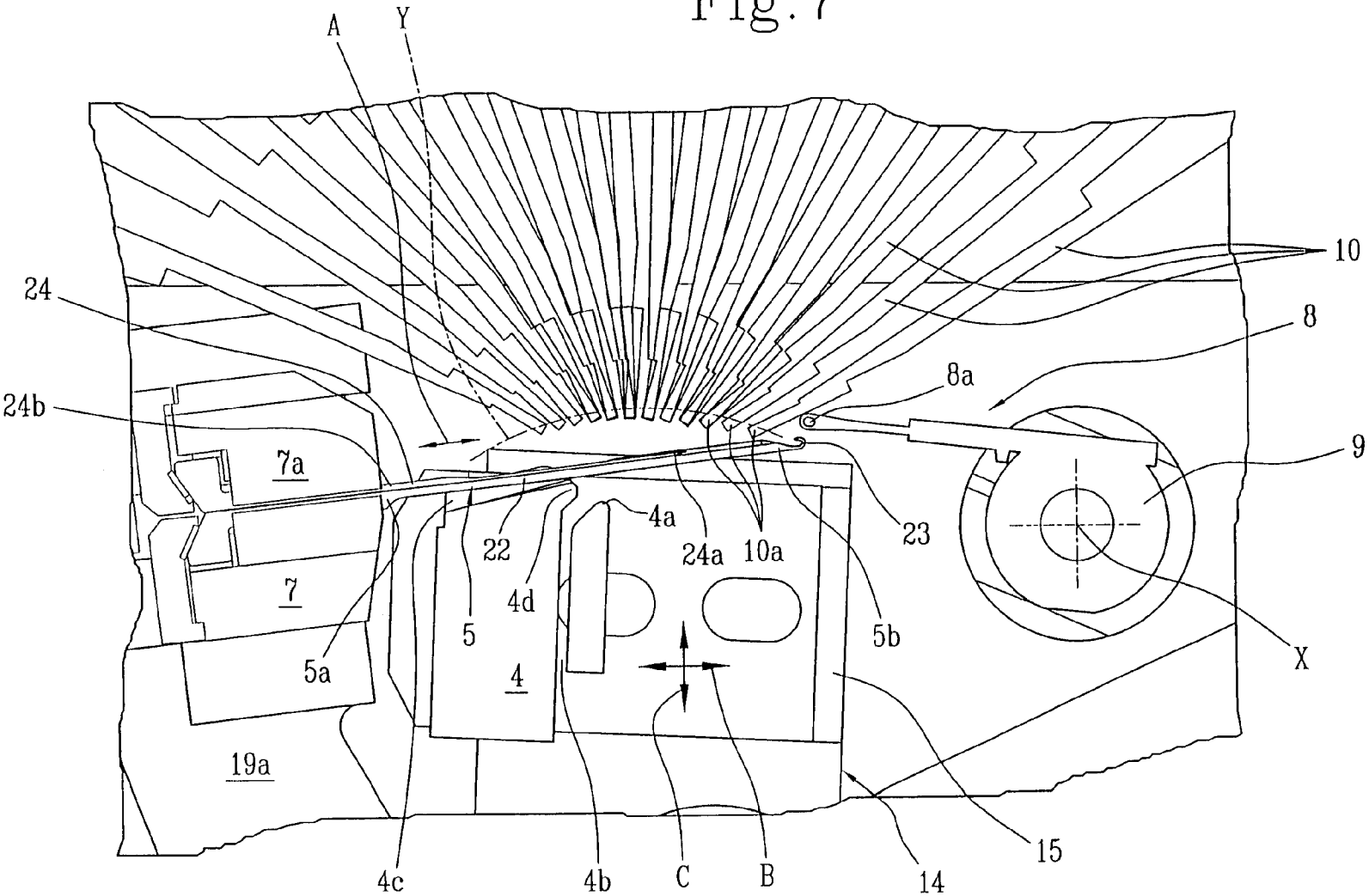

Each needle performs a one-way movement towards the threading tubes 10 and upwards following an arched path leading it to sequentially overlap the lower ends 10*a* of all tubes 10 (FIGS. 5, 6 and 7 in succession). The path is therefore coincident with the above mentioned arched line "Y" on which these lower ends 10*a* are disposed. The arched path is determined by the sum of the oscillating motion of the first arm 14 and the oscillating motion of the second arm 19 relative to the first one 14.

Figure 8:
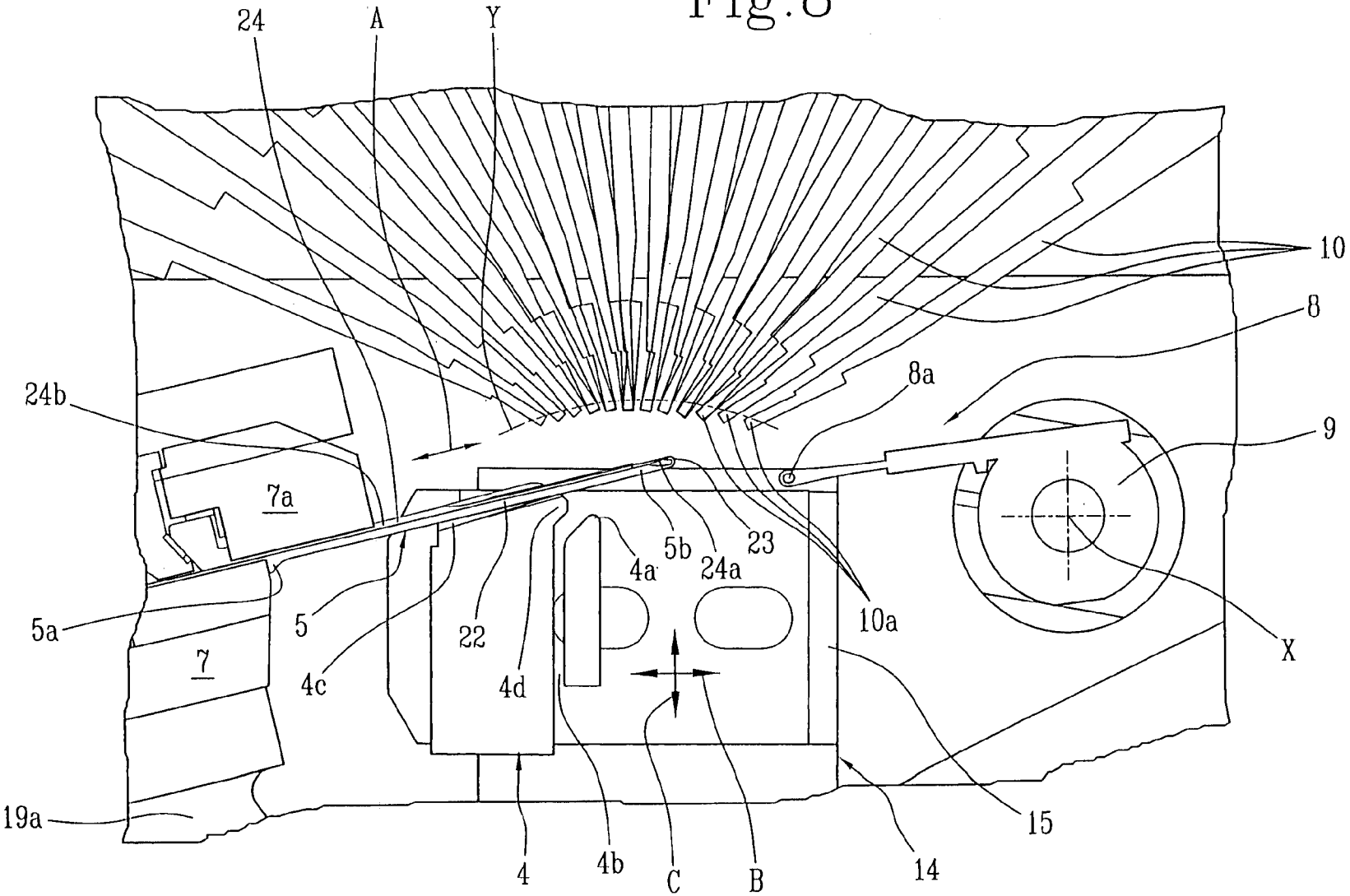

During the one-way movement of needles 5 sliding in grooves 4*c*, the front grooved bar 4 first moves upwards (FIG. 6) then moves downwards and shifts towards the eye-pointed needles 8 (FIGS. 7 and 8).

In the configuration in FIG. 7, the front grooved bar 4 has reached the position that is the closest to the eye-pointed needles 8, and needles 5 have reached the position that is the most advanced towards said eye-pointed needles 8.

Shifting of the front grooved bar 4 towards the eye-pointed needles 8 enables the length of each needle 5 projecting in overhanging beyond the front edge 4*d* of the guide grooves 4*c* close to the hollow space 4*b* to be limited, above all in the case of eye-pointed needles very far from needles 5 due to interposition of a high number of threading tubes 10.

Subsequently, the front grooved bar 4 moves further downwards and needles 5 are retracted (FIG. 7) until they come back to the starting position seen in FIG. 5.

During this movement, the distal ends 5*a* of needles 5 describe a substantially elliptic path "E" (denoted in chain dot line in FIG. 5) with the major axis of the ellipsis oriented substantially horizontally.

The edge 4*d* of the grooves 4*c* defines a substantially elliptic path "D" (denoted in chain dot line in FIG. 6) with the major axis of the ellipsis oriented substantially vertically.

In addition, different points from the distal end 15 of the first arm 14 follow different paths. In fact, in the position in FIGS. 1 and 5, the distal end 15 of the first arm 15 is slightly inclined towards needles 5 while in FIGS. 4 and 8 this end 15 is slightly inclined towards the eye-pointed needles.

At all events, irrespective of the exact movement in the plane of needles 5 and of the front grooved bar 4 it is important to point out that needles 5 have a direct alternated motion component along the first longitudinal extension. This alternated motion component is relative with respect to the front grooved bar 4, and the bar 4 itself has a direct motion component like the longitudinal extension of needles 5 and in the same way as the motion of the needles 5 themselves, to follow the alternated movement of needles 5 along said longitudinal direction.

The present invention reaches the intended purposes and achieves important advantages.

First of all, the machine in accordance with the invention enables productivity to be increased by virtue of an increase in the operating speed.

This speed increase can take place due to a reduction in the bending vibrations of the needles obtained by giving the guide grooves of the front grooved bar a movement accompanying the longitudinal movement of the needles themselves. In this way projection of the needles from said guide grooves is reduced as much as possible.

In addition, the overall length of the needles too is more reduced, because the needle bar can move closer to the eye-pointed needles without running the risk of interfering with the front grooved bar.

The crochet galloon machine in reference further enables mechanical interferences between the parts in motion to be avoided in a very safe manner and also production of articles of manufacture free from faults can be ensured, due to a very precise mutual positioning of the needles, the eve-pointed needles and the threading tubes.

Finally, the limited extension of the portion in overhanging of the needles enables adoption of a great number of carrier slide bars, until 20 or more, so that complicated decorations can be executed using a greater number of weft yarns as compared with looms of known type.

The invention claimed is:

1. A crochet galloon machine for warp knitting, comprising:

a base (2);

a front grooved bar (4) installed on a supporting base (2);

a plurality of needles (5) disposed consecutively in side by side relationship along the front grooved bar (4);

a plurality of eye-pointed needles (8) disposed consecutively in side by side relationship, parallel to the front grooved bar (4) and in front of the needles (5), and each provided to engage a respective warp yarn;

actuating means (6) for longitudinal movement of the needles (5) to give said needles (5) a reciprocating motion along a first direction (A) substantially parallel to the longitudinal extension thereof;

actuating means for transverse movement of the eye-pointed needles (8) to give said eye-pointed needles (8) a reciprocating motion substantially parallel to the longitudinal extension of the front grooved bar (4);

a plurality of threading tubes (10) disposed consecutively in side by side relationship, parallel to the front grooved bar (4) above the needles (5) and each provided to engage a respective weft yarn;

actuating means for transverse movement of the threading tubes (10) to transmit a reciprocating motion to said threading tubes (10) which is parallel to the longitudinal extension of the front grooved bar (4), so that the threading tubes (10) perform a relative movement with respect to the needles (5) which extends on either side of the needles (5) themselves;

characterised in that it further comprises actuating means (13) for movement of the front grooved bar (4) to give said front grooved bar (4) an alternated motion component along a second direction (B) substantially parallel to the first motion direction (A) of the needles (5) so as to accompany the movement of said needles (5) in their alternated longitudinal motion.

2. A crochet galloon machine as claimed in claim 1, further comprising actuating means (13*a*) for transverse movement of the needles (5) to transmit an alternated overlapping movement to said needles (5) along a third direction (C) substantially perpendicular to the first direction (A) and to the transverse movement of the eye-pointed needles (8), so that the eye-pointed needles (8) perform a relative movement with respect to the needles (5) that circumscribes the longitudinal axes of said needles (5), by effect of the combination of said overlapping movement of the needles (5) with the transverse movement of the eye-pointed needles (8).

3. A crochet galloon machine as claimed in claim 2, wherein the actuating means (13) for movement of the front grooved bar (4) also gives said front grooved bar (4) an alternated motion component along the third direction (C), so that said bar (4) moves close to or away from the threading tubes (10).

4. A crochet galloon machine as claimed in claim 3, wherein the alternated motion component along the second direction (B) and the alternated motion component along the third direction (C) define a closed path (E) for the front grooved bar (4).

5. A crochet galloon machine as claimed in claim 3, wherein the closed path (E) described by the front grooved bar (4) is substantially elliptic.

6. A crochet galloon machine as claimed in claim 3, wherein the alternated motion component along the first direction (A) and the alternated motion component along the third direction (C) define a closed path (D) for the distal end (5*b*) of each of said needles (5).

7. A crochet galloon machine as claimed in claim 6, wherein the closed path (D) of the distal end (5*b*) of each of said needles (5) is substantially elliptic.

8. A crochet galloon machine as claimed in claim 1, wherein the needles (5) are movable relative to the front grooved bar (4) along the first direction (A) in respective guide grooves (4*c*) formed in said front grooved bar (4).

9. A crochet galloon machine as claimed in claim 3, wherein the actuating means (13) for movement of the front grooved bar (4) comprises at least one first oscillating drive arm (14) supporting the front grooved bar (4) on a distal end (15) thereof.

10. A crochet galloon machine as claimed in claim 9, wherein said at least one first drive arm (14) is eccentrically hinged on a respective first power-driven shaft (17) rotatably mounted on the base (2).

11. A crochet galloon machine as claimed in claim 10, wherein the actuating means (13) for movement of the front grooved bar (4) further comprises at least one first connecting rod (18) having a first end (18*a*) hinged on the respective first drive arm (14) and a second end (18*b*) hinged on the base (2).

12. A crochet galloon machine as claimed in claim 9, wherein the actuating means (6, 13*a*) for movement of the needles (5) comprises at least one second drive arm (19)

supporting a needle bar (4) on a distal end (19*a*) thereof, hinged on the respective first drive arm (14) and oscillating relative to said first drive arm (14).

13. A crochet galloon machine as claimed in claim 12, wherein the second drive arm (19) is eccentrically hinged on the first drive arm (14) relative to the first power-driven shaft (17).

14. A crochet galloon machine as claimed in claim 13, wherein the actuating means (6, 13*a*) for movement of the needles (5) further comprises at least one second connecting rod (20) having a first end (20*a*) hinged on the respective second drive arm (19) and a second end (20*b*) eccentrically hinged on a respective second power-driven shaft (21) rotatably mounted on the base (2).

15. A crochet galloon machine as claimed in claim 1, wherein each needle (5), at a distal end thereof, has a hook (23) provided with a latch (39) that is resiliently deformable between an open position and a loop-shaped position of said needle (5).

16. A crochet galloon machine as claimed in claim 1, wherein each needle (5) comprises a first portion (22) having a hook (23) at a distal end (22*a*) thereof, and a second portion (24) that is movable relative to the first portion (22) between an open position, at which the second portion (24) is spaced apart from the hook (23), and a closed position at which the second portion (24) lies against the hook (23) to define a closed loop; the crochet gallon machine (1) comprising actuating means (25) for moving the second portion (24) relative to the first portion (22).

17. A crochet galloon machine as claimed in claim 16, wherein the actuating means (24) for movement of the second portion (24) of the needles (5) comprises at least one actuator (37) installed on the distal end (19*a*) of the second drive arm (19) and operatively connected to the second portion (24).

18. A crochet galloon machine as claimed in claim 16, wherein the actuating means (25) for movement of the second portions (24) of the needles (5) comprises a slider (16) installed on the distal end (19*a*) of the second drive arm (19), said slider (26) carrying the second portions (24) of the needles (5) and being movable in translation relative to the needle bar (7), and a kinematic mechanism (27) to move the slider (26) on said distal end (19*a*).

19. A crochet galloon machine as claimed in claim 18, wherein the kinematic mechanism (27) comprises: a first rod (29) having a first end (29*a*) hinged on the slider (26) and a second end (29*b*) opposite to the first (29*a*) one; a connecting body (30) having a first vertex (30*a*) hinged on the second end (29*b*) of the first rod (29), and a second (30*b*) and a third (30*c*) vertices; a second rod (31) having a first end (31*a*) hinged on the second vertex (30*b*) of the connecting body (30) and a second end (31*b*) eccentrically hinged on a respective third power-driven shaft (32) rotatably mounted on the base (2); a third rod (33) having a first end (33*a*) hinged on the third vertex (30*c*) of the connecting body (30), and a second end (33*b*) hinged on the base (2); a fourth rod (34) having a first end (34*a*) hinged on the third rod (33) and a second end (34*b*) eccentrically hinged on a respective fourth power-driven shaft (35) rotatably mounted on the base (2).

20. A crochet galloon machine as claimed in claim 1, wherein the threading tubes (10) are simultaneously operated with alternated oscillation in a vertical direction; said oscillating movement being co-ordinated with that of the needles (5) and the eye-pointed needles (8), so that each weft yarn is selectively laid on either side of one or more needles (5) so as to pass under said needles (5) when the latter reach the return end of stroke and begin the forward movement towards the eye-pointed needles (8) again.

* * * * *